US006803518B2

(12) United States Patent
Chang

(10) Patent No.: US 6,803,518 B2
(45) Date of Patent: Oct. 12, 2004

(54) HIGH FREQUENCY TRANSMISSION CABLE

(75) Inventor: Che-Chia Chang, Taipei (TW)

(73) Assignee: Comax Technology Inc., Taipei (TW)

( * ) Notice: Subject to any disclaimer, the term of this patent is extended or adjusted under 35 U.S.C. 154(b) by 0 days.

(21) Appl. No.: 10/205,415

(22) Filed: Jul. 26, 2002

(65) Prior Publication Data

US 2004/0017264 A1 Jan. 29, 2004

(51) Int. Cl.[7] ..... H01B 7/29; H01B 11/06

(52) U.S. Cl. ..... 174/36; 174/113 R; 333/1; 333/5

(58) Field of Search ..... 174/34, 36, 102 R, 174/105 R, 106 R, 113 R, 117 F; 333/1, 5

(56) References Cited

U.S. PATENT DOCUMENTS 4,323,721 A * 4/1982 Kincaid et al. ..... 174/36
4,755,629 A * 7/1988 Beggs et al. ..... 174/34
4,987,394 A * 1/1991 Harman et al. ..... 333/237
5,247,270 A * 9/1993 Harman et al. ..... 333/237
5,416,268 A * 5/1995 Ellis ..... 174/36
5,483,020 A * 1/1996 Hardie et al. ..... 174/36
5,565,653 A * 10/1996 Rofidal et al. ..... 174/113 R
6,444,902 B1 * 9/2002 Tsao et al. ..... 174/36
6,630,624 B2 * 10/2003 Tsao et al. ..... 174/36
6,740,808 B1 * 5/2004 Chang ..... 174/36

* cited by examiner

*Primary Examiner*—Michael Tokar
*Assistant Examiner*—Khai Nguyen
(74) *Attorney, Agent, or Firm*—Troxell Law Office PLLC

(57) ABSTRACT

A high frequency transmission cable includes one or more propagation channel sets, an inner covering wrapping the propagation channel sets and providing an effect of shield, drain wires and a jacket. Two conductors in each of the propagation channels are joined to each other tightly as a single piece to perform communication of electrical appliances in a way of the conductor pair juxtaposing and being flush with each other surely for avoiding signals transmitted in the conductors becoming not synchronous due to the conductors being in inconsistent length resulting from the cable being bent so as to enhance the frequency width of the transmission cable.

8 Claims, 5 Drawing Sheets

HIGH FREQUENCY TRANSMISSION CABLE

BACKGROUND OF THE INVENTION

1. Field of the Invention

The present invention relates to a high frequency transmission cable and, in particular, to a high frequency transmission cable with conductors in the propagation channels thereof being kept juxtaposed and equal in lengths.

2. Description of Related Art

Due to functions of the central processing unit of a computer having been upgraded, the net bandwidth increasing and storage medium data rising tremendously, both the input and output interfaces of the periphery are getting necessary to provide larger bandwidth so that the standard for wide band transmission cables are regulated largely like bamboo shoots after spring. However, problems, such as transmission delay, impedance matching, cross talk, ground noise control and electromagnetic wave radiation interference, resulting from high frequency signals are getting serious in the transmission cables along with the increased bandwidths of the transmission cables.

As for the transmission interfaces in a computer, Serial ATA, the serial transmission equipment, is a transmission cable providing with the highest bandwidth at the present time. Because the Serial ATA has two conductors, i.e., a transmission pair, being used as a transmission channel set for transmitting differential NRZ signal, the conductors in the same transmission channel being very much different from each other in their lengths causes signals transmitted at the same time from the input end being not possible to reach the output end simultaneously in the process of signal transmission. That is, the signals emitted from the input end are possible to be received synchronously.

The difference value of relative propagation delay between two conductors in the field of testing differential signal transmission cables, i.e., the so-called intra pair skew, as shown in FIG. 5, is defined as that a positive signal and a negative signal are transmitted from the input end to the output end via two conductors respectively and transmission time durations t1, t2 for the two signals are measured with the test standard for the transmission based on the signal pulse reaching a middle voltage value and the difference value of the two transmission time durations |t1−t2| is the intra pair skew.

For a conventional cable used for transmitting low frequency signal, the transmission quality affected by inconsistent lengths of the conductors therein is inconspicuous. However, while the frequency of the signal loaded in the transmission cable increases, especially, to more than 1 GHz, the inversed propagation delay between output ends is close to the frequency of the signal and the intra pair skew can affect the quality of the output signal directly. Hence, the influence brought with the intra pair skew is significantly and it becomes a key factor of bandwidth limitation to the conductors.

Referring to FIG. 1, the currently used high frequency cable mainly has two transmission channel sets 10*a*, 10*a*' and each of the transmission channel sets 10*a*, 10*a*' includes two independent conductors 11*a*, 11*a*', a drain wire 30*a* disposed at two opposite lateral sides of the transmission channel set 10*a*, 10*a*', an inner covering 20*a* providing an effect of shield and wrapping both outer sides of the conductors 11*a*, 11*a*' and the drain wire 30*a*, and a jacket 40*a* covering the inner covering 20*a* to constitute a high frequency cable. The inner covering 20*a* includes a conductive layer 21*a* and an insulation layer 22*a* from an inner side to an outer side thereof.

But, the preceding transmission cable has the following problem in practice. For being stored up or delivered handily after having been fabricated, the transmission cable is coiled up. But, the two conductors in the transmission channel easily displace because of being bent during the process of coiling such that it is not easy to control the conductors in their lengths in case of being cut and as soon as the transmission cable is connected to connectors and the transmission channel therein is loaded with high frequency signals, it results in an excessive large intra pair skew due to the two conductors being unequal in their lengths such that it is unable for the output end to receive the signals synchronously and the bandwidth of the transmitting frequency is limited.

SUMMARY OF THE INVENTION

Accordingly, an object of the present invention is to provide a high frequency transmission cable to secure the conductors in every propagation channel being kept juxtaposed and equal lengths even if the transmission cable is bent instead of the two conductors being misplaced and unequal as the prior art does so that the propagation delay at the output end can be reduced to enhance the bandwidth of the signal in the transmission cable.

In order to reach the preceding object, the high frequency transmission cable has two conductors in each propagation channel set being wrapped tightly as a single piece to perform communication of electrical appliances in a way of the conductor pair really being juxtaposed and flush with each other for avoiding signals transmitted in the conductors becoming not synchronous due to the conductors being in inconsistent lengths resulting from the cable being bent so as to enhance the frequency width of the transmission cable.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
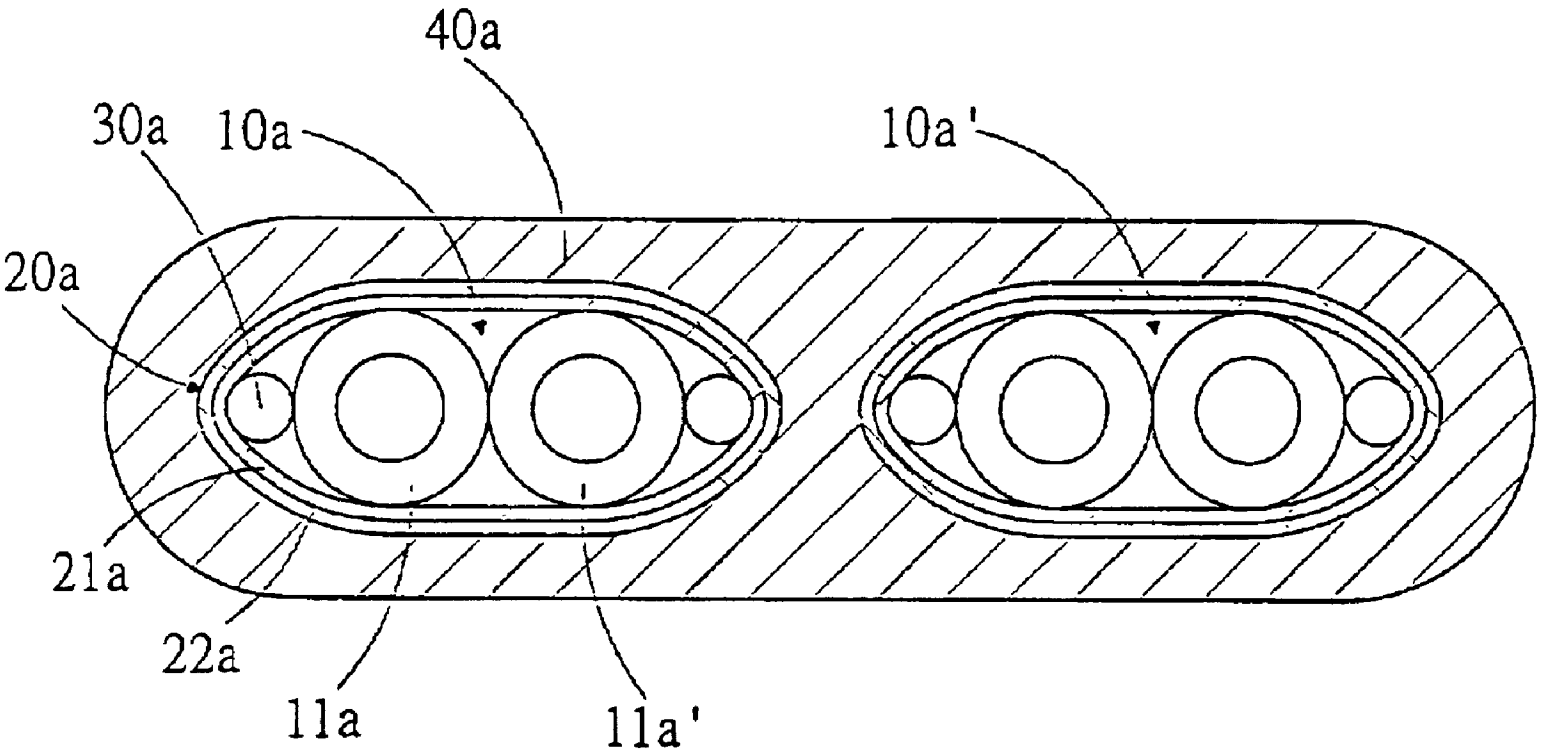
(PRIOR ART) FIG. 1
FIG. 1 is a sectional view of a conventional transmission cable.
Figure 2:
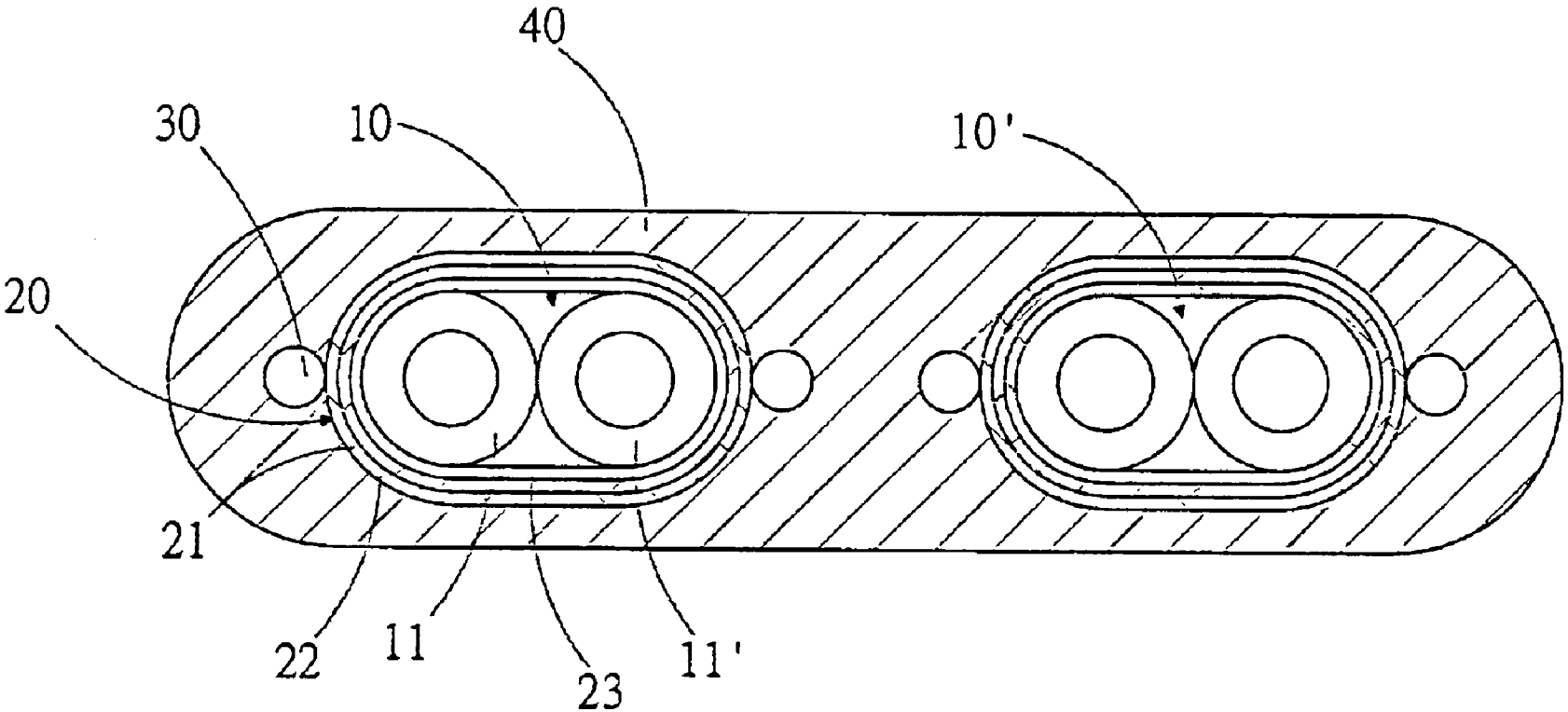
FIG. 2 is a sectional view of a transmission cable according to the present invention in an embodiment thereof.

Referring to FIG. 2, a high frequency transmission cable comprises one or more propagation channel sets 10, 10' for carrying out communication of electric appliances, a respective inner covering 20 for covering and protecting each propagation channel set 10, 10', a drain wire 30 and a jacket 40. Each propagation channel set 10, 10' has a pair of conductors 11, 11' being tightly joined or tied together as a single piece to secure the pair of conductors 11, 11' being juxtaposed and flush with each other for avoiding signals transmitted in the conductors 11, 11' becoming not synchronous due to inconsistent lengths resulting from the cable being bent. In this way, it is capable of enhancing the bandwidth of the transmission cable.

The preceding each propagation channel set 10, 10' has the conductors 11, 11' to form a transmission pair for transmitting differential NRZ signals such that one conductor 11 can transmit positive electrical signal and the other conductor 11' can transmit negative electrical signal. Further, the inner covering at least contains an insulation layer 22, a conductive layer 21 distributing over the insulation layer 22 for preventing from shield caused by the electromagnetic interference and a locating layer 23 for fixing the conductors. The conductive layer 21 can be a gold foil, a silver foil or aluminum foil. The inner covering 20 at two outer lateral sides thereof is arranged with a drain wire 30 respectively such that external interference can be isolated from the internal transmission signals by way of the inner covering and the drain wire.

While the cable is made, two independent conductors 11, 11' are prepared and are arranged to juxtapose to each other with being flattened tightly by a preset tension force. Then, a strip insulator is provided with a facial side thereof paved with conductive layer 21 such as an aluminum foil and the other facial side thereof distributed with thermo-melting plastics. The thermo-melting plastic material such as Form PE or Form PP is the same material as the insulation plastic covering at the outer layer of the conductor 11. Of course, PE or PP can be used instead of Form PE or Form PP. Next, the two conductors 11, 11' are coiled up or enclosed with the strip insulator tightly with the thermo-melting plastic material part being arranged as the inner side the strip insulator. The conductors 11, 11' are heated up immediately right after being coiled up or enclosed with the strip insulator so that the thermo-melting plastic material melts to join with the insulation plastic covering as a locating layer 23 so as to form the inner covering 20. Further, the drain wire 30 is disposed at two lateral sides of the shield. Finally, the jacket 40 is formed by way of PVC, PE or PP being injection molded to cover the entire conductors 11, 11'. Hence, a high frequency transmission cable with the conductor pair 11, 11' being in a state of juxtaposing and being equal in their lengths can be fixed up completely.

Figure 3:
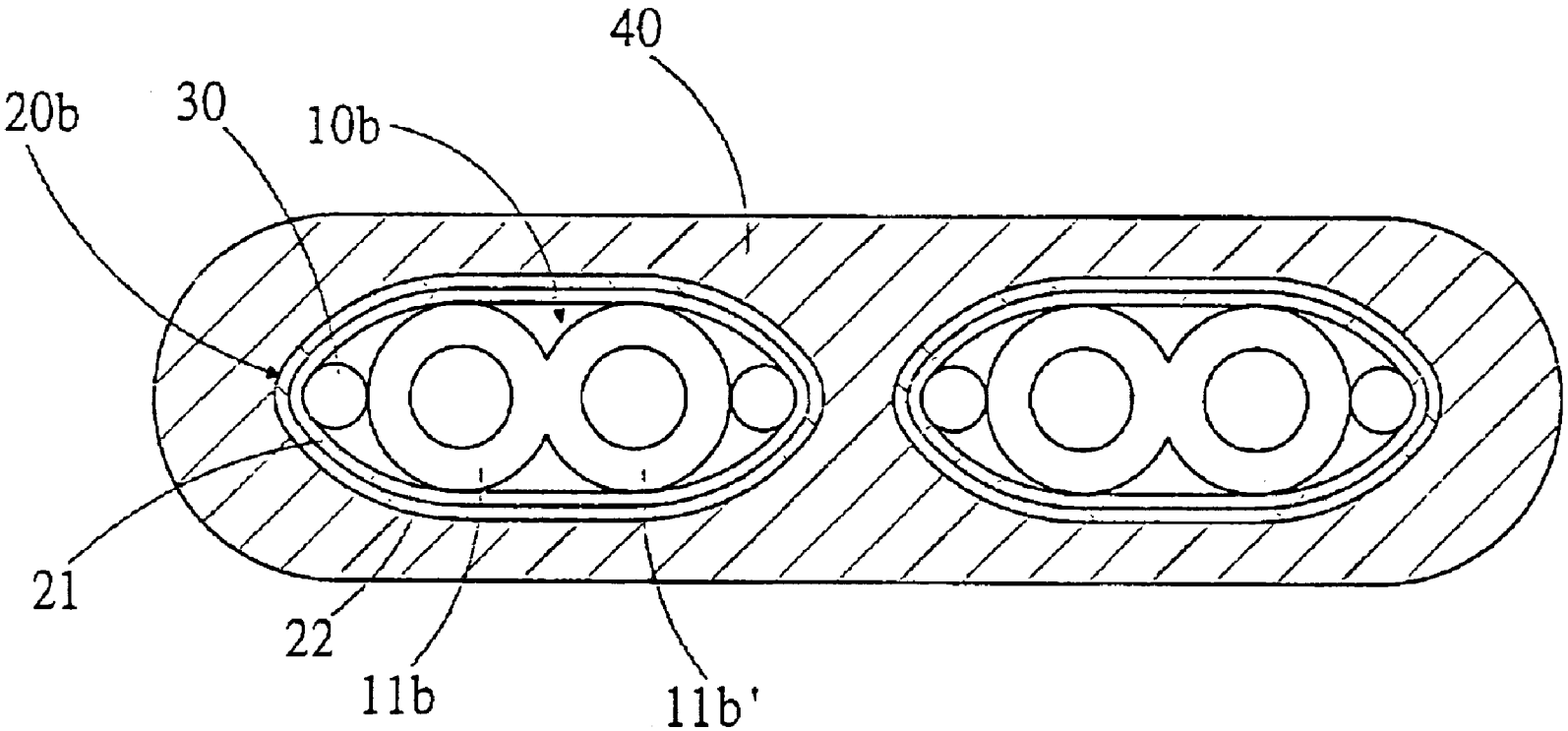
FIG. 3 is a sectional view of another embodiment of the present invention.

Besides, referring to FIG. 3, another embodiment of the present invention is illustrated. While the cable is made, two conductors 11*b*, 11*b'* are fabricated as a set by way of wiring arrangement to form a propagation channel 10*b* for carrying out communication job of electrical appliances. The two conductors 11*b*, 11*b'* are juxtaposed to each other with being flattened tightly by a preset tension force. Then, a strip insulator layer 22 is provided with a facial side thereof paved with a conductive layer 21 such as an aluminum foil. The two conductors 11*b*, 11*b'* are wrapped by a coiled strip insulator tightly with a facial side thereof having metal material being as the outer side. In this way, the inner covering 20*b* is formed after the two conductors 11*b*, 11*b'* being enclosed completely. Further, at least a drain wire 30 next to the conductive layer 21 is attached to the inner covering at the outer side thereof. Finally, the jacket 40 is formed by way of PVC, PE or PP being injection molded to cover the entire conductors 11*b*, 11*b'*. Hence, a high frequency transmission cable with conductor pair 11*b*, 11*b'* being juxtaposed and equal in their lengths can be fixed up completely.

Figure 4:
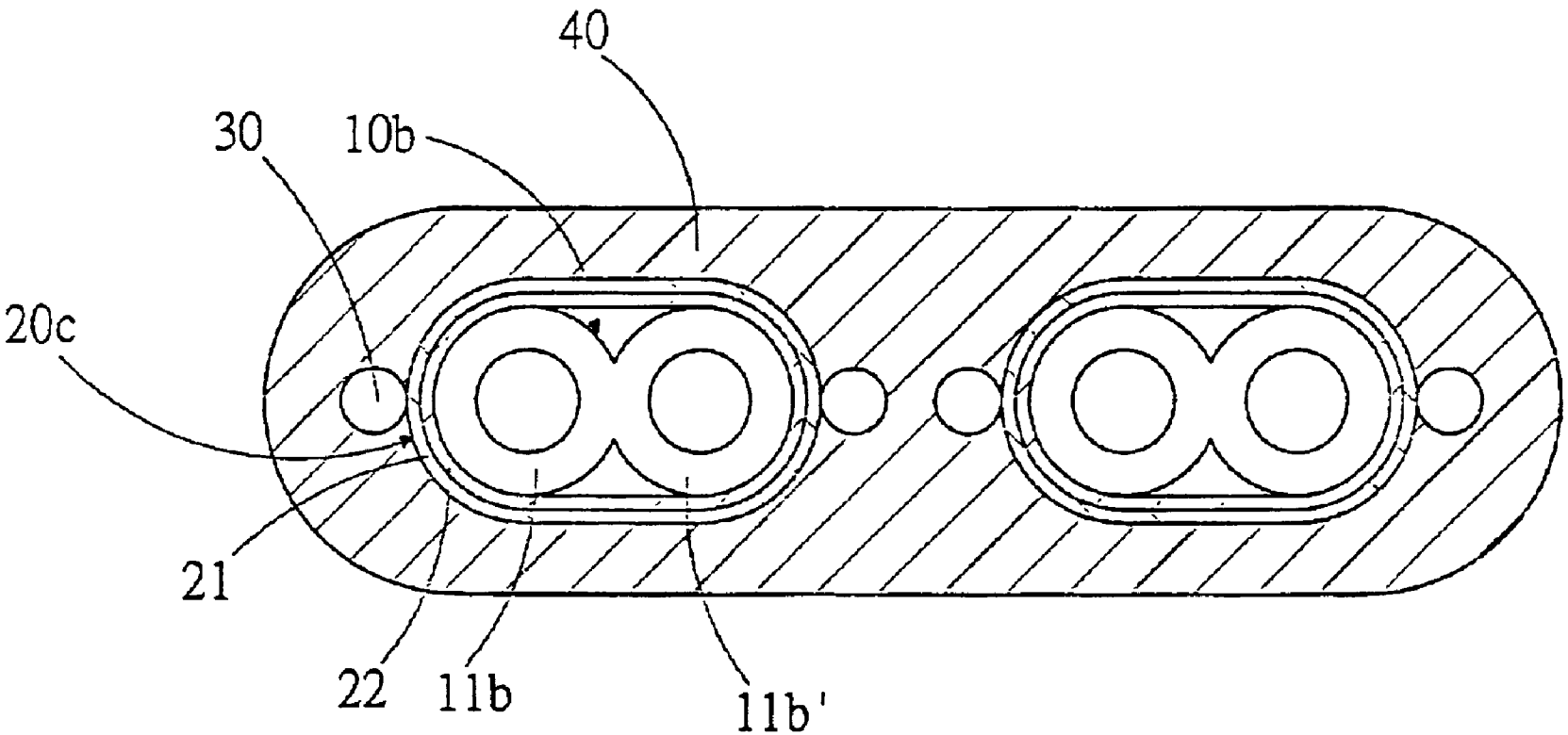
FIG. 4 is a sectional view of a further embodiment of the present invention.
Figure 5:
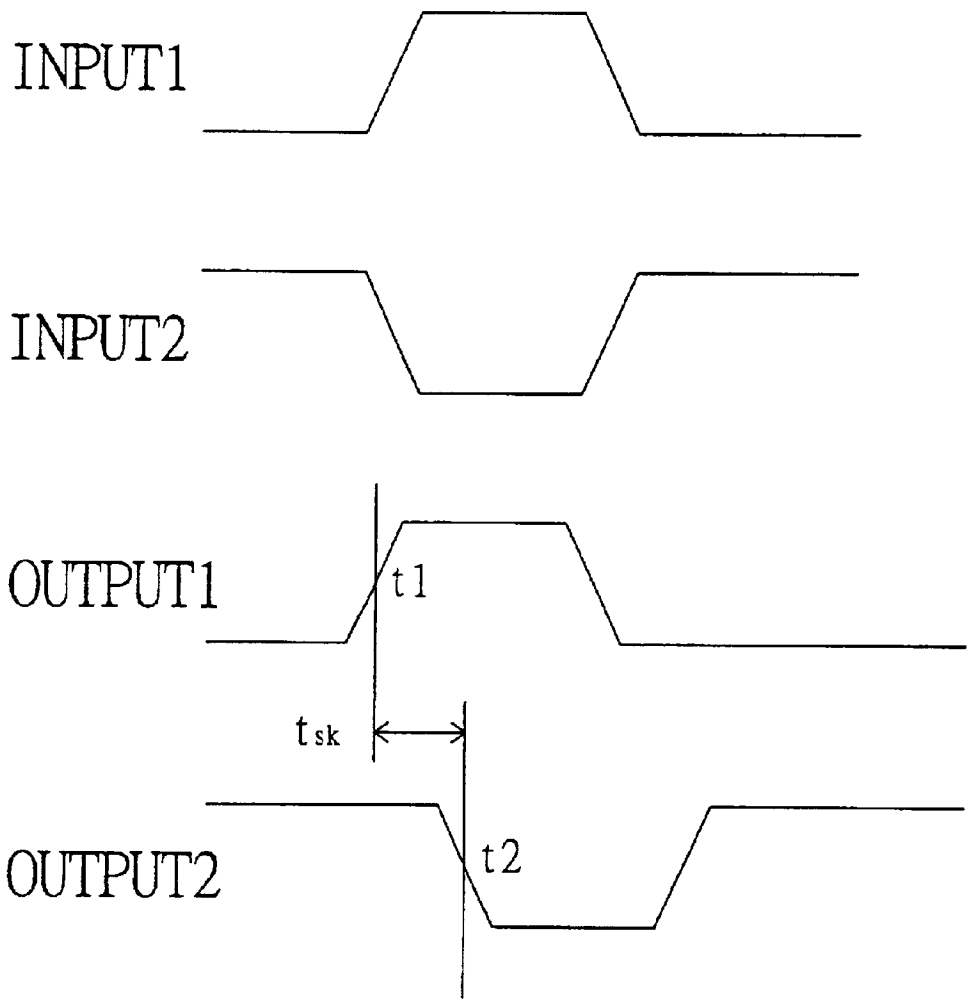
FIG. 5 is a schematic diagram illustrating transmission time difference between two lead cables.

Furthermore, referring to FIG. 4, a further embodiment of the present invention is illustrated. While the cable is made, two conductors 11*b*, 11*b'* are fabricated as a pair by way of wiring arrangement to form a propagation channel 10 for carrying out communication job of electrical appliances. The two conductors 11*b*, 11*b'* are juxtaposed to each other with being flattened tightly by a preset tension force. Then, a strip insulator layer 22 is provided with a facial side thereof paved with a conductive layer 21 such as an aluminum foil. The two conductors 11*b*, 11*b'* are wrapped by the strip insulator tightly with a facial side thereof attached with metal material being as the inner side thereof. In this way an inner covering 20*c* is formed after the two conductors 11*b*, 11*b'* being wrapped completely. Further, at least a drain wire 30 next to the conductive layer 21 is attached to the inner covering 20*c* at the outer side thereof. Finally, the jacket 40 is formed by way of PVC, PE or PP being injection molded to cover the entire conductors 11*b*, 11*b'*. Hence, a high frequency transmission cable with juxtaposed and equal length conductor pair 11*b*, 11*b'* can be fixed up completely.

As the foregoing, the conductors of the propagation channel according to the present invention can be joined to each other as an integral piece by way of a locating layer or wiring arrangement to keep the two conductors being juxtaposed instead of being misplaced or inconsistent in lengths. In this way, it is possible to reduce the time difference between the output ends of the transmission pair effectively during the signal being transmitted by way of the cable so as to increase the frequency width thereof.

While the invention has been described with reference to the a preferred embodiment thereof, it is to be understood that modifications or variations may be easily made without departing from the spirit of this invention, which is defined by the appended claims.

What is claimed is:

1. A high frequency transmission cable comprising:

a) at least one propagation channel set, each propagation channel set having two independent conductors;

b) a three-layer inner covering located around each propagation channel set and having:

i) a locating layer;

ii) an insulation layer located on the locating layer; and iii) a conductive layer located on the insulation layer;

c) at least one drain wire on an exterior of each three-layer inner covering; and d) a jacket located around the at least one drain and each three-layer inner covering, wherein the two independent conductors of each propagation channel set are positioned juxtaposed and flush, and adjoined as a single piece by the locating layer, such that the two independent conductors are a consistent length to transmit synchronous signals.

2. The high frequency transmission cable as defined in claim 1, wherein the locating layer is made of thermo-melting plastics.

3. The high frequency transmission cable as defined in claim 1, wherein the three-layer inner covering is formed by way of a strip material enwinding and wrapping the two independent conductors.

4. The high frequency transmission cable as defined in claim 1, wherein jacket is made of a material selected from a group consisting of PVC, PE and PP.

5. A high frequency transmission cable comprising:

a) at least one propagation channel set, each propagation channel set having two independent conductors;

b) at least one inner covering located around each propagation channel set and having:

i) an insulation layer; and iii) a conductive layer;

c) at least one drain wire located adjacent to the conductive layer; and d) a jacket forming an outer most protective layer, wherein the two independent conductors of each propagation channel set are positioned juxtaposed and flush, and formed as a single piece, such that the two independent conductors are a consistent length to transmit synchronous signals, wherein the insulation layer is located on an interior of the conductive layer and the at least one drain wire is located on an exterior of the conductive layer.

6. The high frequency transmission cable as defined in claim 5, wherein the inner covering is formed by way of a strip of material enwinding and wrapping the two independent conductors.

7. The high frequency transmission cable as defined in claim 5, wherein jacket is made of a material selected from a group consisting of PVC, PE and PP.

8. The high frequency transmission cable as defined in claim 5, wherein the conductive layer is made of a material selected from a group consisting of gold foil, silver foil and aluminum foil.

* * * * *